US006348308B1

(12) United States Patent
Loccufier et al.

(10) Patent No.: US 6,348,308 B1
(45) **Date of Patent: *Feb. 19, 2002**

(54) SUBSTANTIALLY LIGHT-INSENSITIVE THERMOGRAPHIC RECORDING MATERIAL WITH IMPROVED STABILITY AND IMAGE-TONE

(75) Inventors: Johan Loccufier, Zwijnaarde; David Terrell, Lint; Carlo Uyttendaele, Mortsel; Bartholomeus Horsten, Rumst, all of (BE)

(73) Assignee: Agfa-Gevaert (BE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/135,448

(22) Filed: Aug. 17, 1998

Related U.S. Application Data

(60) Provisional application No. 60/060,336, filed on Sep. 29, 1997.

(30) Foreign Application Priority Data

Sep. 3, 1997 (EP) ..... 97202710

(51) Int. Cl.[7] ..... G03C 1/494; G03C 8/08

(52) U.S. Cl. ..... 430/606; 430/200; 430/616; 430/618; 430/620; 430/611; 430/964

(58) Field of Search ..... 430/200, 203, 430/616, 618, 620, 964, 965, 611, 346, 606; 346/76.1

(56) References Cited

U.S. PATENT DOCUMENTS

| | | | | | |
|---|---|---|---|---|---|
| 3,080,254 | A | | 3/1963 | Grant, Jr. | 117/36.8 |
| 3,997,346 | A | | 12/1976 | Masuda et al. | 96/50 |
| 4,201,582 | A | * | 5/1980 | White | 430/965 |
| 4,451,561 | A | | 5/1984 | Hirabayashi et al. | 430/619 |
| 4,543,309 | A | | 9/1985 | Hirabayashi et al. | 430/31 |
| 5,424,182 | A | * | 6/1995 | Marginean et al. | 430/964 |
| 5,672,560 | A | * | 9/1997 | Rush | 503/209 |
| 5,750,319 | A | * | 5/1998 | Horsten et al. | 430/616 |
| 5,885,765 | A | * | 3/1999 | Horsten et al. | 430/618 |
| 6,030,764 | A | * | 2/2000 | Horsten et al. | 430/611 |

FOREIGN PATENT DOCUMENTS

| | | |
|---|---|---|
| EP | 0713133 | 5/1996 |
| EP | 0809142 | 11/1997 |
| EP | 0809143 | 11/1997 |
| EP | 0809144 | 11/1997 |
| EP | 0814374 | 12/1997 |
| WO | 9416361 | 7/1994 |
| WO | 9610213 | 4/1996 |

* cited by examiner

*Primary Examiner*—Richard L. Schilling
(74) *Attorney, Agent, or Firm*—Leydig, Voit & Mayer, Ltd

(57) ABSTRACT

A substantially light-insensitive monosheet recording material comprising a support and a thermosensitive element containing a substantially light-insensitive organic silver salt, an organic reducing agent therefor in thermal working relationship therewith and a binder, wherein the thermosensitive element further contains an unsaturated carbocyclic or heterocyclic stabilizer compound substituted with a —SA group where A is hydrogen, a counterion to compensate the negative charge of the thiolate group or a group forming a symmetrical or an asymmetrical disulfide and the recording material is capable of producing prints with a numerical gradation value defined as the quotient of the fraction $(2.5–0.1)/(E_{2.5}–E_{0.1})$ greater than 2.3 , where $E_{2.5}$ is the energy in Joule applied in a dot area of 87 $\mu$m×87 $\mu$m of the imaging layer that produces an optical density value of 2.5, and $E_{0.1}$ is the energy in Joule applied in a dot area of the imaging layer material that produces an optical density value of 0.1.

3 Claims, No Drawings

SUBSTANTIALLY LIGHT-INSENSITIVE THERMOGRAPHIC RECORDING MATERIAL WITH IMPROVED STABILITY AND IMAGE-TONE

The application claims the benefit of U.S. Provisional Application No. 60/060,336 filed Sep. 29, 1997.

FIELD OF THE INVENTION

The present invention relates to a substantially light-insensitive thermographic recording material suitable for thermal development. In particular, it concerns improvements in stabilization thereof.

BACKGROUND OF THE INVENTION

Thermal imaging or thermography is a recording process wherein images are generated by the use of imagewise modulated thermal energy. A survey of "direct thermal" imaging methods is given e.g. in the book "Imaging Systems" by Kurt I. Jacobson-Ralph E. Jacobson, The Focal Press—London and New York (1976), Chapter VII under the heading "7.1 Thermography". Direct thermal thermography is concerned with materials which are substantially not photosensitive, but are sensitive to heat or thermosensitive. Imagewise applied heat is sufficient to bring about a visible change in a thermosensitive imaging material.

WO 94/16361 discloses a multilayer heat-sensitive material for direct thermal recording for which no intermediate drying of organic noble metal salts is necessary and which is coatable from aqueous dispersions. This material comprises: a colour-forming amount of finely divided, solid colourless noble metal or iron salt of an organic acid distributed in a carrier composition; a color-developing amount of a cyclic or aromatic organic reducing agent, which at thermal copy and printing temperatures is capable of a colour-forming reaction with the noble metal or iron salt; and an image toning agent; characterized in that (a) the carrier composition comprises a substantially water-soluble polymeric carrier and a dispersing agent for the noble metal or iron salt and (b) the material comprises a protective overcoating layer for the colour-forming layer. This patent application also discloses that suitable antifoggants for use in the invention are well-known photographic antifoggants such as 2-mercaptobenzo-triazole, chromate, oxalate, carbonate, benzotriazole (BZT), 5-methylbenzo-triazole, 5,6-dimethylbenzotriazole, 5-bromobenzotriazole, 5-chlorobenzo-triazole, 5-nitrobenzotriazole, 4-nitro-6-chlorobenzotriazole, 5-nitro-6-chlorobenzotriazole, 4-hydroxy-6-methyl-1,3,3a, 7-tetraazaindene, benzimidazole, 2-methylbenzimidazole, 5-nitrobenzimidazole, 1-phenyl-5-mercaptotetrazole (PMT), 2-mercaptobenzimidazole, 2-mercaptobenzothiazole, 2-mercaptobenzoxazole, 2-mercaptothiazoline, 2-mercapto-4-methyl-6,6'-dimethylpyrimidine, 1-ethyl-2-mercapto-5-amino-1,3,4-triazole, 1-ethyl-5-mercapto-1,2,3,4-tetrazole, 2,5-dimercapto-1,3,4-thiodiazole, 2-mercapto-5-amino-1,3,4-thiodiazole, dimethyldithiocarbamate, and diethyldithiocarbamate.

EP-A 809 143 discloses a substantially non-photosensitive recording material comprising a thermosensitive element comprising a substantially light-insensitive organic silver salt, an organic reducing agent therefor in thermal working relationship therewith and a binder, on a support, characterized in that the thermosensitive element further comprises in reactive association with the substantially light-insensitive organic silver salt and the organic reducing agent a substituted or unsubstituted compound with an unsaturated 5-membered heterocyclic ring consisting of nitrogen and carbon atoms with at least one of the nitrogen atoms having a hydrogen atom and none of the carbon atoms being part of a thione-group, the ring not being annulated with an aromatic ring system and the compound being exclusive of 1,2,4-triazole and substituted 1,2,4-triazole compounds.

EP-A 809 144 discloses a substantially non-photosensitive recording material comprising a thermosensitive element comprising a substantially light-insensitive organic silver salt, an organic reducing agent therefor in thermal working relationship therewith and a binder, on a support, characterized in that the thermosensitive element further comprises in reactive association with the substantially light-insensitive organic silver salt and the organic reducing agent a substituted or unsubstituted 1,2,4-triazole compound with at least one of the nitrogen atoms having a hydrogen atom and none of the carbon atoms being part of a thione-group, the compound not being annulated with an aromatic ring system.

EP-A 809 142 discloses a recording material comprising a support, a thermosensitive element and a protective layer therefor, the thermosensitive element comprising a substantially light-insensitive organic silver salt, an organic reducing agent therefor in thermal working relationship therewith and a binder, wherein the thermosensitive element further comprises in reactive association with the substantially light-insensitive organic silver salt and the organic reducing agent a substituted, exclusive of groups having an exclusively electron withdrawing character, or unsubstituted compound with an unsaturated 5-membered heterocyclic ring annulated with an aromatic ring system, the ring consisting of nitrogen and carbon atoms with at least one of the nitrogen atoms having a hydrogen atom and none of the carbon atoms being directly linked to a sulfur atom or being part of a carbonyl-group.

Prior art stabilizers have been found by the inventors to be unsuitable for stabilizing thermographic materials for graphics applications during storage prior to use.

OBJECTIONS THE INVENTION

It is therefore an object of the invention to provide a means of stabilizing the image of thermographic recording materials during storage.

It is a further object of the invention to provide a process utilizing a substantially non-photosensitive recording material with improved light stabilization to obtain a direct thermal image.

Further objects and advantages of the invention will become apparent from the description hereinafter.

SUMMARY OF THE INVENTION

EP-A 809 142, EP-A 809 143 and EP-A 809 144 address the problem of background colour resulting from exposure to light, which is a particular problem in thermographic materials used for producing continuous tone transparencies for medical and other applications having numerical gradation values less than or equal to 2.3. The present invention addresses the problem of stabilization of the background density during storage prior to use of the intrinsically more thermosensitive thermographic materials based on substantially light-insensitive organic silver salts and reducing agents used for producing steep gradation, so-called graphics images, with numerical gradation values greater than 2.3 as transparencies or on a white support, for which the prior art stabilizers are unsuitable.

The above mentioned objects are realised by a substantially light-insensitive monosheet recording material comprising a support and a thermosensitive element containing a substantially light-insensitive organic silver salt, an organic reducing agent therefor in thermal working relationship therewith and a binder, wherein the thermosensitive element further contains an unsaturated carbocyclic or heterocyclic stabilizer compound substituted with a —SA group where A is hydrogen, a counterion to compensate the negative charge of the thiolate group or a group forming a symmetrical or an asymmetrical disulfide and the recording material is capable of producing prints with a numerical gradation value defined as the quotient of the fraction $(2.5-0.1)/(E_{2.5}-E_{0.1})$ greater than 2.3, where $E_{2.5}$ is the energy in Joule applied in a dot area of 87 $\mu$m×87 $\mu$m of the imaging layer that produces an optical density value of 2.5, and $E_{0.1}$ is the energy in Joule applied in a dot area of the imaging layer material that produces an optical density value of 0.1.

A thermal image recording process is also provided comprising the steps of: (i) providing a substantially light-insensitive recording material, as described above; (ii) bringing an outermost layer of the recording material into proximity with a heat source; (iii) applying heat from a heat source image-wise to the recording material while maintaining proximity to the heat source to produce an image; and (iv) separating the recording material from the heat source.

Preferred embodiments of the invention are disclosed in the dependent claims.

DETAILED DESCRIPTION OF THE INVENTION

According to preferred embodiment a thermal image forming process, according to the present invention, is realized, wherein the heat source is a thermal head.

Substantially

By substantially light-insensitive is meant not intentionally light sensitive.

Stabilizer Compounds

The stabilizer compound for use in the present invention may be further substituted, which substitution also includes the atoms necessary to form an annulated unsaturated carbocyclic or heterocyclic ring system. Preferred substituents include acylamido, aryl-$SO_2NH$—, alkyl-$SO_2NH$—, aryl-$NHSO_2$—, alkyl-$NHSO_2$—, arylamino, alkyl, aryl, nitro and cyano groups and halogen atoms. Preferred stablizer compounds used in the present invention have an unsaturated 5- or 6-membered ring. According to a preferred embodiment of the stabilizer compounds used in the present invention the stabilizer compound is represented by formula (I):

(I)

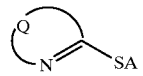

where Q are the necessary atoms to form a 5- or 6-membered aromatic heterocyclic ring, A is selected from hydrogen, a counterion to compensate the negative charge of the thiolate group or a group forming a symmetrical or an asymmetrical disulfide. The thus formed 5- or 6-membered aromatic heterocyclic ring may also be substituted.

Particularly preferred stabilizer compounds used in the present invention are represented by the formulae:

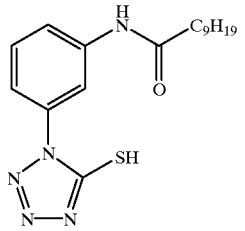

and

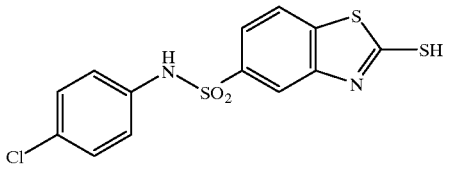

Suitable stabilizer compounds for use in the present invention are given below:

S-I

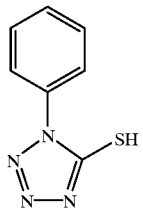

S-II

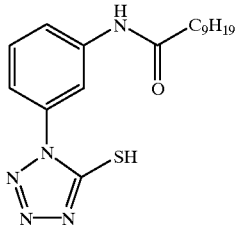

-continued
S-III
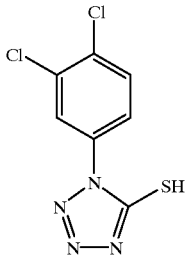
S-IV
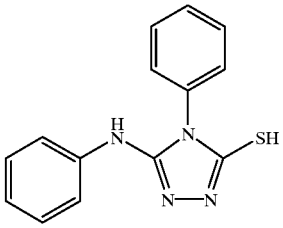
S-V
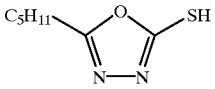
S-VI
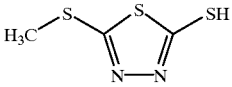
S-VII
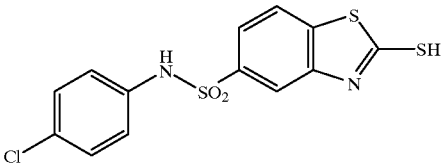
S-VIII
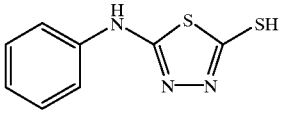
S-IX
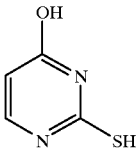
S-X
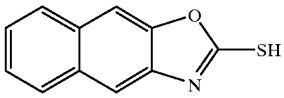
S-XI
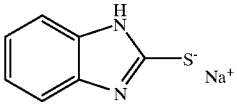
S-XII
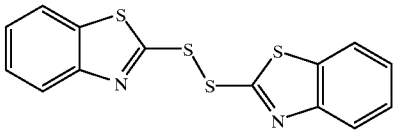
-continued
S-XIII
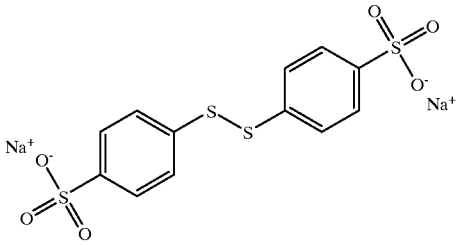
S-XIV
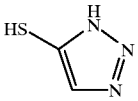
S-XV
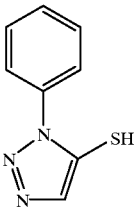
S-XVI
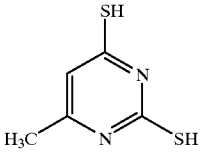
S-XVII
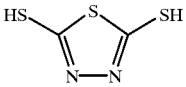
S-XVIII
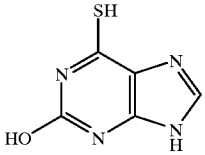
S-XIX
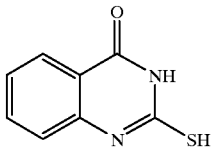
S-XX
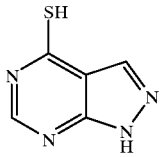
S-XXI
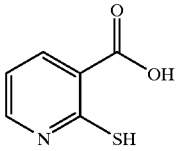

-continued

S-XXII

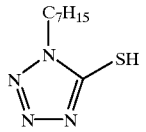

S-XXIII

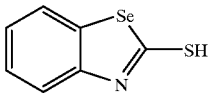

S-XXIV

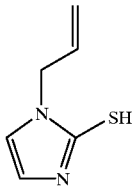

S-XXV

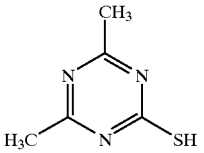

S-XXVI

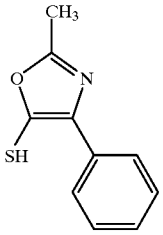

S-XXVII

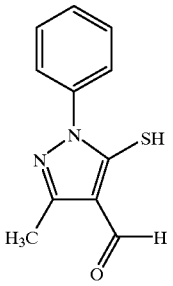

Thermosensitive Element

The thermosensitive element, according to the present invention, comprises a substantially light-insensitive organic silver salt and an organic reducing agent therefor in thermal working relationship therewith in reactive association with a compound with an unsaturated 5-membered heterocyclic ring. The element may comprise a layer system in which the ingredients may be dispersed in different layers, with the proviso that all three ingredients are in reactive association with one another i.e. during the thermal development process the reducing agent and the stabilizer compound must be present in such a way that they are able to diffuse to the substantially light-insensitive organic silver salt particles so that reduction of the organic silver salt to silver giving the desired image-tone can take place. Furthermore the stabilizer compound must be present in such a way that the thermosensitive element can be stabilized against the influence of light.

Organic Silver Salts

Preferred organic silver salts according to the present invention are silver salts of aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, with silver behenate being particularly preferred. Such silver salts are also called "silver soaps". In addition silver dodecyl sulphonate described in U.S. Pat. No. 4,504,575; and silver di-(2-ethylhexyl)-sulfosuccinate described in EP-A 227 141, modified aliphatic carboxylic acids with thioether group as described e.g. in GB-P 1,111,492 and other organic silver salts as described in GB-P 1,439,478, e.g. silver benzoate and silver phthalazinone, may be used likewise to produce a thermally developable silver image. Further are mentioned silver imidazolates and the substantially light-insensitive inorganic or organic silver salt complexes described in U.S. Pat. No. 4,260,677. Combinations of different organic silver salts can also be used in the recording materials of the present invention.

Reducing Agents

Suitable organic reducing agents for the reduction of the substantially light-insensitive organic silver salts are organic compounds containing at least one active hydrogen atom linked to O, N or C, such as is the case with, aromatic di- and tri-hydroxy compounds; aminophenols; METOL™; p-phenylenediamines; alkoxynaphthols, e.g. 4-methoxy-1-naphthol described in U.S. Pat. No. 3,094,41; pyrazolidin-3-one type reducing agents, e.g. PHENIDONE™; pyrazolin-5-ones; indan-1,3-dione derivatives; hydroxytetrone acids; hydroxytetronimides; hydroxylamine derivatives such as for example described in U.S. Pat. No. 4,082,901; hydrazine derivatives; and reductones e.g. ascorbic acid; see also U.S. Pat. Nos. 3,074,809, 3,080,254, 3,094,417 and 3,887,378. Preferred catechol-type reducing agents are benzene compounds in which the benzene nucleus is substituted by no more than two hydroxy groups which are present in 3,4-position on the nucleus and have in the 1-position of the nucleus a substituent linked to the nucleus by means of a carbonyl group disclosed in EP-A 692 733.

The silver image density depends on the coverage of the above defined reducing agent(s) and organic silver salt(s) and has to be preferably such that, on heating above 100° C., an optical density of at least 2.5 can be obtained. Preferably at least 0.10 moles of reducing agent per mole of organic silver salt is used.

Auxiliary Reducing Agents

The above mentioned reducing agents, regarded as primary or main reducing agents, may be used in conjunction with so-called auxiliary reducing agents. Such auxiliary reducing agents are e.g. sterically hindered phenols, such as described in U.S. Pat. No. 4,001,026; bisphenols, e.g. of the type described in U.S. Pat. No. 3,547,648; or sulfonamidophenols as described in Research Disclosure 17842 published in February 1979, U.S. Pat. No. 4,360,581, U.S. Pat. No. 4,782,004 and in EP-A 423 891. The auxiliary reducing agents may be present in the imaging layer or in a polymeric binder layer in thermal working relationship thereto.

Other auxiliary reducing agents that may be used in conjunction with the above mentioned primary reducing agents are hydrazides such as disclosed in EP-A 762 196, sulfonyl hydrazide reducing agents such as disclosed in U.S. Pat. No. 5,464,738; trityl hydrazides and formylphenyl-hydrazides such as disclosed in U.S. Pat. No. 5,496,695; trityl hydrazides and formyl-phenyl-hydrazides with diverse auxiliary reducing agents such as disclosed in U.S. Pat. No. 5,545,505, U.S. Pat. No. 5.545.507 and U.S. Pat. No. 5,558,983; acrylonitrile compounds as disclosed in U.S. Pat. No. 5,545,515 and U.S. Pat. No. 5,635,339; and organic reducing metal salts, e.g. stannous stearate described in U.S. Pat. No. 3,460,946 and 3,547,648.

Polycarboxylic Acids and Anhydrides Thereof

According to the substantially light-insensitive recording material of the present invention the thermosensitive element may comprise in addition at least one polycarboxylic acid and/or anhydride thereof in a molar percentage of at least 15 with respect to all the organic silver salt(s) present and in thermal working relationship therewith. The polycarboxylic acid may be aliphatic (saturated as well as unsaturated aliphatic and also cycloaliphatic) or an aromatic polycarboxylic acid, may be substituted and may be used in anhydride form or partially esterified on the condition that at least two free carboxylic acids remain or are available in the heat recording step.

Binders

The film-forming binder of the thermosensitive element containing the substantially light-insensitive organic silver salt may be all kinds of natural, modified natural or synthetic resins or mixtures of such resins, wherein the organic silver salts can be dispersed homogeneously: e.g. cellulose derivatives such as ethylcellulose, cellulose esters, e.g. cellulose nitrate, carboxymethylcellulose, starch ethers, galactomannan, polyesters, polyurethanes, polycarbonates, polymers derived from α,β-ethylenically unsaturated compounds such as after-chlorinated polyvinyl chloride, partially hydrolyzed polyvinyl acetate, polyvinyl alcohol, polyvinyl acetals, preferably polyvinyl butyral, and homopolymers and copolymers produced using monomers selected from the group consisting of: vinyl chloride, vinylidene chloride, acrylonitrile, acrylamides, methacrylamides; methacrylates, acrylates, methacrylic acid, acrylic acid, vinyl esters, styrenes, dienes and alkenes; or mixtures thereof.

The layer containing the organic silver salt is commonly coated onto a support in sheet- or web-form from an organic solvent containing the binder dissolved therein, but may be applied from an aqueous medium as a latex, i.e. as an aqueous polymer dispersion. For use as a latex the dispersible polymer has preferably some hydrophilic functionality.

Binder to Organic Silver Salt Ratio

The ratio of the total weight of any binders in the thermosensitive element to the total weight of organic silver salts in the thermosensitive element is preferably less than 2.0 and the thickness of the recording layer is preferably in the range of 5 to 50 μm.

Thermal Solvent

The above mentioned binders or mixtures thereof may be used in conjunction with waxes or "heat solvents" also called "thermal solvents" or "thermosolvents" improving the reaction speed of the redox-reaction at elevated temperature.

By the term "heat solvent" in this invention is meant a non-hydrolyzable organic material which is in solid state in the recording layer at temperatures below 50° C. but becomes a plasticizer for the recording layer in the heated region and/or liquid solvent for at least one of the redox-reactants, e.g. the reducing agent for the organic heavy metal salt, at a temperature above 60° C.

Toning Agent

In order to obtain a neutral black image tone in the higher densities and neutral grey in the lower densities the recording layer contains preferably in admixture with the organic silver salts and reducing agents a so-called toning agent known from thermography or photothermography. Suitable toning agents are the phthalimides and phthalazinones within the scope of the general formulae described in U.S. Pat. No. 4,082,901. Other particularly useful toning agents are the heterocyclic toner compounds of the benzoxazine dione or naphthoxazine dione type are described in GB-P 1,439,478, U.S. Pat. No. 3,951,660 and U.S. Pat. No. 5,599,647.

Other Additives

The recording layer may contain in addition to the ingredients mentioned above other additives such as free fatty acids, surface-active agents, antistatic agents, e.g. non-ionic antistatic agents including a fluorocarbon group as e.g. in $F_3C(CF_2)_6CONH(CH_2CH_2O)$—H, silicone oil, ultraviolet light absorbing compounds, white light reflecting and/or ultraviolet radiation reflecting pigments and/or optical brightening agents.

Support

The support for the thermal imaging material according to the present invention may be transparent, translucent or opaque, e.g. having a white light reflecting aspect and is preferably a thin flexible carrier made e.g. from paper, polyethylene coated paper or transparent resin film, e.g. made of a cellulose ester, e.g. cellulose triacetate, polypropylene, polycarbonate or polyester, e.g. polyethylene terephthalate.

The support may be in sheet, ribbon or web form and subbed if need be to improve the adherence to the thereon coated thermosensitive recording layer. The support may be made of an opacified resin composition as described in EP's 194 106 and 234 563 and U.S. Pat. Nos. 3,944,699, 4,187,113, 4,780,402 and 5,059,579. Should a transparent base be used, the base may be colourless or coloured, e.g. having a blue colour. One or more backing layers may be provided to control physical properties such as curl.

Outermost Layer

The outermost layer of the substantially light-insensitive recording material may in different embodiments of the present invention be the outermost layer of the thermosensitive element, a protective layer applied to the thermosensitive element or a layer on the opposite side of the support to the thermosensitive element.

Protective Layer

According to a preferred embodiment of the substantially light-insensitive recording material, according to the present invention, the thermosensitive element is coated with a protective layer to avoid local deformation of the thermosensitive element and to improve resistance against abrasion.

The protective layer preferably comprises a binder, which may be hydrophobic (solvent soluble) of hydrophilic (water soluble). Among the hydrophobic binders polycarbonates as described in EP-A 614 769 are particularly preferred. However, hydrophilic binders are preferred for the protective layer, as coating can be performed from an aqueous composition and mixing of the hydrophilic protective layer with the immediate underlayer can be avoided by using a hydrophobic binder in the immediate underlayer.

A protective layer according to the present invention may further comprise a thermomeltable particle optionally with a lubricant present on top of the protective layer as described in WO 94/11199. The lubricant, which may be a surface active agent, a solid lubricant or a liquid lubricant, may be applied with or without a polymeric binder. Other additives can also be incorporated in the protective layer e.g. colloidal particles such as colloidal silica.

Hydrophilic Binder for Outermost Layer

According to an embodiment of the present invention the outermost layer of the substantially light-insensitive recording material may comprise a hydrophilic binder. Suitable hydrophilic binders for the outermost layer are, for example, gelatin, polyvinylalcohol, cellulose derivatives or other polysaccharides, hydroxyethylcellulose, hydroxypropylcellulose etc., with hardenable binders being preferred and polyvinylalcohol being particularly preferred.

Crosslinking Agents for Outermost Layer

The outermost layer according to the present invention may be crosslinked. Crosslinking can be achieved by using crosslinking agents such as described in WO 95/12495 for protective layers, e.g. tetra-alkoxysilanes, polyisocyanates, zirconates, titanates, melamine resins etc., with tetraalkoxysilanes such as tetramethylorthosilicate and tetraethylorthosilicate being preferred.

Matting Agents for Outermost Layer

The outermost layer of the substantially light-insensitive recording material according to the present invention may comprise a matting agent. Suitable matting agents are described in WO 94/11198 and include e.g. talc particles and optionally protrude from the outermost layer.

Lubricants for Outermost Layer

Solid or liquid lubricants or combinations thereof such as described above for use in protective layers are also suitable for incorporation in the outermost layer to improve the slip characteristics of the substantially light-insensitive recording materials according to the present invention.

Antistatic Layer

In a preferred embodiment the substantially light-insensitive recording material of the present invention an antistatic layer is the outermost layer on the other side of the support to the thermosensitive element.

Coating

The coating of any layer of the substantially light-insensitive recording material of the present invention may proceed by any coating technique e.g. such as described in Modern Coating and Drying Technology, edited by Edward D. Cohen and Edgar B. Gutoff, (1992) VCH Publishers Inc., 220 East 23rd Street, Suite 909 New York, N.Y. 10010, U.S.A.

Processing Configurations

Thermographic imaging is carried out by the image-wise application of heat either in analogue fashion by direct exposure through an image of by reflection from an image, or in digital fashion pixel by pixel either by using an infra-red heat source, for example with a Nd-YAG laser or other infra-red laser, or by direct thermal imaging with a thermal head.

In thermal printing image signals are converted into electric pulses and then through a driver circuit selectively transferred to a thermal printhead. The thermal printhead consists of microscopic heat resistor elements, which convert the electrical energy via the Joule effect into heat, which is transferred to the surface of the thermographic material, wherein the chemical reaction resulting in the development of a black and white image takes place. Such thermal printing heads may be used in contact or close proximity with the recording layer. The operating temperature of common thermal printheads is in the range of 300 to 400° C. and the heating time per picture element (pixel) may be less than 1.0 ms, the pressure contact of the thermal printhead with the recording material being e.g. 200–500 g/cm$^2$ to ensure a good transfer of heat.

In order to avoid direct contact of the thermal printing heads with a recording layer not provided with an outermost protective layer, the image-wise heating of the recording layer with the thermal printing heads may proceed through a contacting but removable resin sheet or web wherefrom during the heating no transfer of recording material can take place.

The image signals for modulating the laser beam or current in the micro-resistors of a thermal printhead are obtained directly or from an intermediary storage means. Activation of the heating elements can be power-modulated or pulse-length modulated at constant power. EP-A 654 355 describes a method for making an image by image-wise heating by means of a thermal head having energizable heating elements, wherein the activation of the heating elements is executed duty cycled pulse-wise. When used in thermographic recording operating with thermal printheads the thermographic materials are not suitable for reproducing images with fairly large number of grey levels as is required for continuous tone reproduction. EP-A 622 217 discloses a method for making an image using a direct thermal imaging element producing improvements in continuous tone reproduction. Image-wise heating of the thermographic material can also be carried out using an electrically resistive ribbon incorporated into the material. Image- or pattern-wise heating of the thermographic material may also proceed by means of pixel-wise modulated ultra-sound, using e.g. an ultrasonic pixel printer as described e.g. in U.S. Pat. No. 4,908,631.

Industrial Application

Direct thermal imaging can be used for both the production of transparencies and reflection type prints. Application of the present invention is envisaged in the fields of graphics images requiring high contrast images with a very steep print density applied dot energy dependence. In the hard copy field substantially light-insensitive recording materials on a white opaque base are used as well as transparencies used in inspection techniques operating with a light box.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appending claims. The invention is illustrated hereinafter by way of invention examples and comparative examples. The percentages and ratios given in these examples are by weight unless otherwise indicated. The ingredients used in the INVENTION and COMPARATIVE EXAMPLES which are not elucidated in the EXAMPLES are:

Surfactant Nr. 1=MERSOLAT™ H80, a sodium hexadecyl-sulfonate from Bayer;

Surfactant Nr. 2=ULTRAVON™ W, a sodium arylsulfonate from Ciba-Geigy;

AgBeh: silver behenate, the organic silver salt used;

B79: BUTVAR™ B79, a polyvinyl butyral from Monsanto;

R01: ethyl 3,4-dihydroxybenzoate, the organic reducing agent;

T01: benzo[e][1,3]oxazine-2,4-dione, the toning agents;

Oil: Baysilone™ A from Bayer AG, used as a levelling agent;

COMPARATIVE EXAMPLE 1 & INVENTION EXAMPLES 1 to 5

Thermosensitive Element

A 100 μm thick support coated with the following subbing-layer composition:

| | |
|---|---|
| # terpolymer latex of vinylidene chloride/methyl acrylate/itaconic acid (88/10/2): | 162 mg/m$^2$ |
| # colloidal silica (KIESELSOL ™ 100F from BAYER): | 38 mg/m$^2$ |
| # alkyl sulfonate surfactant (Surfactant Nr. 1): | 0.6 mg/m$^2$ |
| # aryl sulfonate surfactant (Surfactant Nr. 2) : | 4 mg/m$^2$ |

was doctor blade-coated with a coating composition containing butanone as a solvent and the following ingredients so as to obtain thereon. After drying for 1 hour at room temperature and then 1 hour at 50° C., layers with the compositions given in table 1 for COMPARATIVE EXAMPLE 1 and INVENTION EXAMPLES 1 to 5 were obtained.

TABLE 1

| | AgBeh | B79 | R01 | T01 | Oil | stabilizer compound | |
|---|---|---|---|---|---|---|---|
| | [g/m$^2$] | [g/m$^2$] | [g/m$^2$] | [g/m$^2$] | [g/m$^2$] | type | [g/m$^2$] |
| Comparative Example nr | | | | | | | |
| 1 | 5.2 | 5.2 | 0.97 | 0.38 | 0.017 | — | — |
| Invention Example nr | | | | | | | |
| 1 | 5.2 | 5.2 | 0.97 | 0.38 | 0.017 | S-II | 0.20 |
| 2 | 5.2 | 5.2 | 0.97 | 0.38 | 0.017 | S-II | 0.81 |
| 3 | 5.2 | 5.2 | 0.97 | 0.38 | 0.017 | S-VIII | 0.12 |
| 4 | 5.2 | 5.2 | 0.97 | 0.38 | 0.017 | S-VII | 0.21 |
| 5 | 5.2 | 5.2 | 0.97 | 0.38 | 0.017 | S-VII | 0.83 |

Thermographic Printing

During printing of the recording materials of COMPARATIVE EXAMPLE 1 and INVENTION EXAMPLES 1 to 5 the print head was separated from the imaging layer by a thin intermediate material contacted with a slipping layer of a separable 5 μm thick polyethylene terephthalate ribbon coated successively with a subbing layer, heat-resistant layer and the slipping layer (anti-friction layer) giving a ribbon with a total thickness of 6 μm.

The printer was equipped with a thin film thermal head with a resolution of 300 dpi and was operated with a line time of 32 ms (the line time being the time needed for printing one line). During this line time the print head received constant power. The average printing power, being the total amount of electrical input energy during one line time divided by the line time and by the surface area of the heat-generating resistors was 1.86 mJ/dot being sufficient to obtain maximum optical density in each of the thermographic materials of COMPARATIVE EXAMPLE 1 and INVENTION EXAMPLES 1 to 5.

Image Evaluation

The maximum densities, $D_{max}$, and minimum densities $D_{min}$, of the prints were measured through a blue filter with a MacBeth™ TR904 densitometer in the grey scale step corresponding to data levels of 255 and 0 respectively and are given in table 2.

Shelf-life Test

The shelf-life of prints made with the thermographic materials of COMPARATIVE EXAMPLE 1 and INVENTION EXAMPLES 1 to 5 was evaluated on the basis of the observed changes in minimum density, $\Delta D_{min}$, and maximum density, $\Delta D_{max}$, printing the thermographic recording materials before and after heating the materials at 57° C. in a relative humidity (RH) of 34% for 3 days in the dark. The results are given in table 2.

TABLE 2

| | stabilizer compound | | FRESH | | | SHELF-LIFE TEST 3 d at 57° C./34% RH | |
|---|---|---|---|---|---|---|---|
| | type | [g/m²] | $D_{min}$ (blue) | $D_{max}/D_{min}$ (ortho) | numerical gradation value | $\Delta D_{min}$ (blue) | $\Delta D_{max}/\Delta D_{min}$ (ortho) |
| Comparative Example number | | | | | | | |
| 1 | — | — | 0.07 | 4.3/0.07 | 4.7 | +0.03 | −0.49/+0.01 |
| Invention Example nr | | | | | | | |
| 1 | S-II | 0.20 | 0.08 | 3.8/0.07 | 4.9 | 0.00 | +0.1/0.00 |
| 2 | S-II | 0.81 | 0.08 | 3.1/0.07 | 3.8 | 0.00 | +0.5/0.00 |
| 3 | S-VIII | 0.12 | 0.08 | 3.7/0.08 | 4.5 | 0.00 | 0.0/−0.01 |
| 4 | S-VII | 0.21 | 0.07 | 3.4/0.06 | 4.3 | −0.01 | +0.5/0.00 |
| 5 | S-VII | 0.83 | 0.05 | 2.8/0.05 | 2.5 | +0.02 | +0.2/−0.01 |

A comparison of the results obtained with the substantially light-insensitive recording materials of INVENTION EXAMPLES 1 to 5 with those obtained with the substantially light-insensitive recording materials of COMPARATIVE EXAMPLE 1 show that stabilizer compounds S-II, S-VII and S-VIII exhibit a stabilizing effect on $D_{min}$ measured through a blue filter, as seen by a reduction in $\Delta D_{min}$ (blue), and for the most part also measured through an ortho filter as seen by a reduction in $\Delta D_{min}$ (ortho), while for the most part having a less reducing affect on $D_{max}$ measured through an ortho filter, as seen by more positive $\Delta D_{max}$ (ortho) values.

Having described in detail preferred embodiments of the current invention, it will now be apparent to those skilled in the art that numerous modifications can be made therein without departing from the scope of the invention as defined in the following claims.

What is claimed is:

1. A substantially light-insensitive monosheet recording material comprising a support and a thermosensitive element comprising a substantially light-insensitive silver salt of an aliphatic carboxylic acid, an organic reducing agent therefor in thermal working relationship therewith, a binder, and a stabilizing system against the influence of light consisting essentially of a stabilizer compound represented by the following formula:

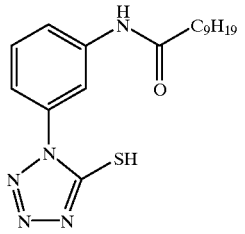

wherein said recording material is capable of producing prints with a numerical gradation value of greater than 2.3.

2. A substantially light-insensitive monosheet recording material comprising a support and a thernosensitive element comprising a substantially light-insensitive silver salt of an aliphatic carboxvlic acid, an organic reducing agent therefor in thermal working relationship therewith, a binder, and a stabilizing system against the influence of light consisting essentially of a stabilizer compound represented by the following formula:

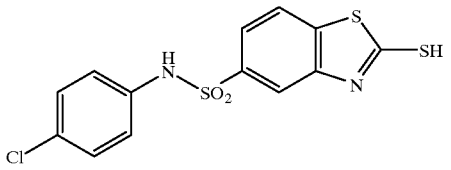

wherein said recording material is capable of producing prints with a numerical gradation value of greater than 2.3.

3. Recording material according to claim 1, wherein said thermosensitive element is coated with a protective layer.

* * * * *